US006368069B1

(12) United States Patent
Fukanuma et al.

(10) Patent No.: US 6,368,069 B1
(45) Date of Patent: Apr. 9, 2002

(54) VARIABLE DISPLACEMENT COMPRESSOR

(75) Inventors: Tetsuhiko Fukanuma; Masahiro Kawaguchi; Masanori Sonobe; Masakazu Murase; Yoshinobu Ishigaki, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/389,187

(22) Filed: Sep. 2, 1999

(30) Foreign Application Priority Data

Sep. 8, 1998 (JP) ..... 10-254066

(51) Int. Cl.[7] ..... F04B 1/12
(52) U.S. Cl. ..... 417/222.2; 417/269; 92/71
(58) Field of Search ..... 417/222.2, 269; 62/193; 92/71; 91/486; 74/60

(56) References Cited

U.S. PATENT DOCUMENTS 3,789,740 A * 2/1974 Boyer ..... 91/485
3,939,717 A * 2/1976 Teisen ..... 74/60
4,586,874 A * 5/1986 Hiraga et al. ..... 417/222.2
5,293,810 A 3/1994 Kimura et al. ..... 92/12.2
5,380,166 A * 1/1995 Terauchi ..... 417/269
5,387,091 A * 2/1995 Kawaguchi et al. ..... 417/222.2
5,433,137 A * 7/1995 Ikeda et al. ..... 92/71
5,540,559 A * 7/1996 Kimura et al. ..... 417/222.2
5,884,497 A * 3/1999 Kishita et al. ..... 62/193
5,921,756 A * 7/1999 Matsuda et al. ..... 417/269

FOREIGN PATENT DOCUMENTS

JP 06-299958 10/1994
JP 08-338364 12/1996

* cited by examiner

*Primary Examiner*—Charles G. Freay
(74) *Attorney, Agent, or Firm*—Morgan & Finnegan, LLP

(57) ABSTRACT

Pistons are accommodated in each cylinder bores of a variable displacement compressor. A swash plate is coupled to the piston for converting rotation of the drive shaft to reciprocation of the pistons. A thrust bearing located between a rotor and a housing of the compressor. The outermost load-bearing points of the thrust bearing are radially farther from the axis of the drive shaft than the axes of the pistons. This permits the thrust bearing to directly receive a reaction forces from the pistons through the rotor without applying a moment to the bearing.

8 Claims, 6 Drawing Sheets

VARIABLE DISPLACEMENT COMPRESSOR

BACKGROUND OF THE INVENTION

The present invention relates to a variable displacement compressor for vehicle air-conditioning systems.

In a prior art compressor shown in FIGS. 6 and 7, a housing 102 includes a crank chamber 101, and a drive shaft 103 is rotatably supported by the housing 102. A rotor 104 is secured to the drive shaft 103 in the crank chamber 101. A drive plate, or a swash plate 105, is supported by the drive shaft 103 to slide axially and to incline with respect to the axis L. A hinge mechanism 106 couples the rotor 104 to the swash plate 105. The swash plate 105 integrally rotates with the drive shaft 103 through the hinge mechanism 106.

A cylinder block 108 constitutes part of the housing 102. A plurality of cylinder bores 108*a* (six in the compressor of FIG. 7) are formed in the cylinder block 108. The cylinder bores 108*a* are arranged on a circle about the axis L of the drive shaft 103 at equal intervals. A piston 107 is accommodated in each cylinder bore 108*a*. Each piston is coupled to the swash plate 105 through a pair of shoes 115. When the drive shaft 103 is rotated, the swash plate 105 is rotated through the rotor 104 and the hinge mechanism 106. The rotation of the swash plate 105 is converted into reciprocation of each piston 107 in the corresponding cylinder bore 108*a* through the shoes 115.

A thrust bearing 109 is located between the rotor 104 and an inner wall 102*a* of the housing 102. The thrust bearing 109 includes rollers 109*a* and a pair of ring-shaped races 109*b*. The rollers 109*a* are arranged about the axis L of the drive shaft 103 and are held between the pair of races 109*b*. Each roller extends radially. The thrust bearing 109 receives a compression force applied to the rotor 104 from the pistons 107 through the swash plate 105 and the hinge mechanism 106.

A discharge chamber 120 is connected to the crank chamber 101 through a pressurizing passage 110. A displacement control valve 111 is provided in the pressurizing passage 110. The control valve 111 adjusts the opening size of the pressurizing passage 110 and controls the flow rate of refrigerant gas fed to the crank chamber 101 from the discharge chamber 120. This varies the difference between the pressure in the crank chamber 101 and the pressure in the cylinder bores 108*a*. The inclination angle of the swash plate 105 is varied in accordance with the pressure difference through the hinge mechanism 106, which controls the displacement of the compressor.

The control valve 111 includes a valve body 112, a solenoid 113, and a pressure sensitive mechanism 114. The valve body 112 opens and closes the pressurizing passage 110. The solenoid 113 urges the valve body 112 toward its closed position. The pressure sensitive mechanism 114 operates the valve body 112 in accordance with the pressure (suction pressure) in a suction chamber 121. The valve body 112 is operated by the pressure sensitive mechanism 114 and the solenoid 113 to vary the opening size of the pressurizing passage 110.

When the cooling load is great, the electric current supplied to the solenoid 113 is increased, which increases a force urging the valve body 112 to reduce the opening size of the pressurizing passage 110. In this case, the pressure sensitive mechanism 114 operates the valve body 112 to lower a target value of the suction pressure. In other words, the control valve 111 adjusts the displacement of the compressor so that a lower suction pressure is maintained by increasing the current supply to the solenoid 113.

When the cooling load is small, the supply of electric current to the solenoid 113 is decreased, which decreases the force urging the valve body toward its closed position. In this case, the pressure sensitive mechanism 114 operates the valve body 112 to raise the target value of the suction pressure. In other words, the control valve 111 adjusts the displacement of the compressor so that a higher suction pressure is maintained decreasing the electric current supplied to the solenoid 113.

As shown in FIG. 6, the swash plate 105 includes a point D1 corresponding to the top dead center position of each piston 107 and a point D2 corresponding to the bottom dead center position of each piston 107. In FIG. 6, the upper piston 107 is positioned at the top dead center by the swash plate 105 corresponding to point D1, and the lower piston 107 is positioned at the bottom dead center by the part of the swash plate 105 corresponding to point D2. The hinge mechanism 106 is axially aligned with point D1.

As shown in FIG. 7, each piston 107 located on the part of the swash plate 105 ranging from point D1 to point D2 in the rotational direction (clockwise) of the swash plate 105 is performing a compression stroke, in which the piston moves from the bottom dead center to the top dead center. In the compression stroke, a compression reaction force applied to each piston 107 pushes the swash plate 105 toward the rotor 104. On the other hand, each piston located on the part of the swash plate 105 ranging clockwise from point D2 to point D1 in FIG. 7 is performing a suction stroke, in which the piston 107 moves from the top dead center to the bottom dead center. During the suction stroke, the negative pressure in the cylinder bore 108*a* causes the piston to pull the swash plate 105.

Thus, the direction of the forces applied to the part of the swash plate 105 corresponding to the pistons 107 performing compression strokes is opposite to that of the forces applied to the part of the swash plate 105 corresponding to the pistons 107 performing suction strokes. Therefore, as shown in FIG. 7, a resultant force F of the forces applied to the swash plate 105 from the pistons 107 is offset from the axis L of the drive shaft 103. Accordingly, a moment based on the resultant force F is applied to the rotor 104, and the moment inclines the rotor 104 with respect to a plane perpendicular to the axis L of the drive shaft 103.

The control valve 111 operates the valve body 112 using the pressure sensitive mechanism 114 and the solenoid 113 to adjust the displacement of the compressor. The compressor shown in FIG. 6 can vary the compression ratio, which is the ratio of the discharge pressure to the suction pressure. For example, when the supply of electric current to the solenoid 113 is increased, which lowers the target suction pressure, the displacement is maximized by the pressure sensitive mechanism 114, and this increases the compression ratio. In contrast, when the supply of the electric current to the solenoid 113 is decreased, which raises the target suction pressure, an intermediate displacement is set by the pressure sensitive mechanism 114, and this decreases the compression ratio.

The location of the resultant force F applied to the swash plate 105 from the pistons 107 varies radially. As shown in FIG. 7, the resultant force F can be located further from the axis L than an effective reception radius r1. The effective reception radius r1 is the radius of a circle defined by the outer-most points of contact between the rollers 109*a* and the races 109*b*. A force applied at a location within the effective reception radius r1 is directly transferred to the housing by the thrust bearing 109.

The phenomenon that the position of the resultant force F varies radially from the effective reception radius r1 was discovered through an experiment performed by the present inventors. In the experiment, when the compression ratio was lowest, the location of the force F extended to a radius r2, which is the radius of the axis S of the pistons 107. Accordingly, the resultant force F applied to the swash plate 105 is not directly received by the thrust bearing 109 through the rotor 104. Therefore, an inclination moment based on the resultant force F inclines the rotor 104, which increases the clearance between the housing 102 and one side of the bearing. As a result, the thrust bearing 109 is subject to chattering, which causes noise and vibration.

The present invention relates to a variable displacement compressor having a thrust bearing that can directly receive the force applied to a drive plate from pistons.

To achieve the above objective, the present invention provides a variable displacement compressor having the following structure. A housing defines a crank chamber, a suction chamber and a discharge chamber. A drive shaft is rotatably supported in the housing. A plurality of cylinder bores are formed in the housing. Each cylinder bore is arranged on a circle which center is the axis of the drive shaft. A plurality of pistons are accommodated in the cylinder bores. A drive plate is coupled to the piston for converting rotation of the drive shaft to reciprocation of the piston. The drive plate inclines and slides axially along the drive shaft, which varies the piston stroke to change the displacement of the compressor. A control valve controls pressure in the crank chamber to change the inclination of the drive plate. The control valve includes a valve body, an electric drive means for applying force to the valve body corresponding to the value of the current fed to the electric drive means. A rotor is mounted on the drive shaft to rotate integrally with the drive shaft. A hinge mechanism is located between the rotor and the drive plate. The hinge mechanism rotates the drive plate integrally with the rotor and for guiding the motion of the drive plate. A thrust bearing is located between the rotor and the housing. The thrust bearing receives a resultant force of the pistons through the rotor and the hinge mechanism. An effective reception radius, which is defined by an outermost load-bearing point of the thrust bearing, is greater than the distance from the axis of the drive shaft to the axis of any one of the pistons.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A variable displacement compressor for vehicle air-conditioning systems according to one embodiment of the present invention will now be described.

Figure 1:
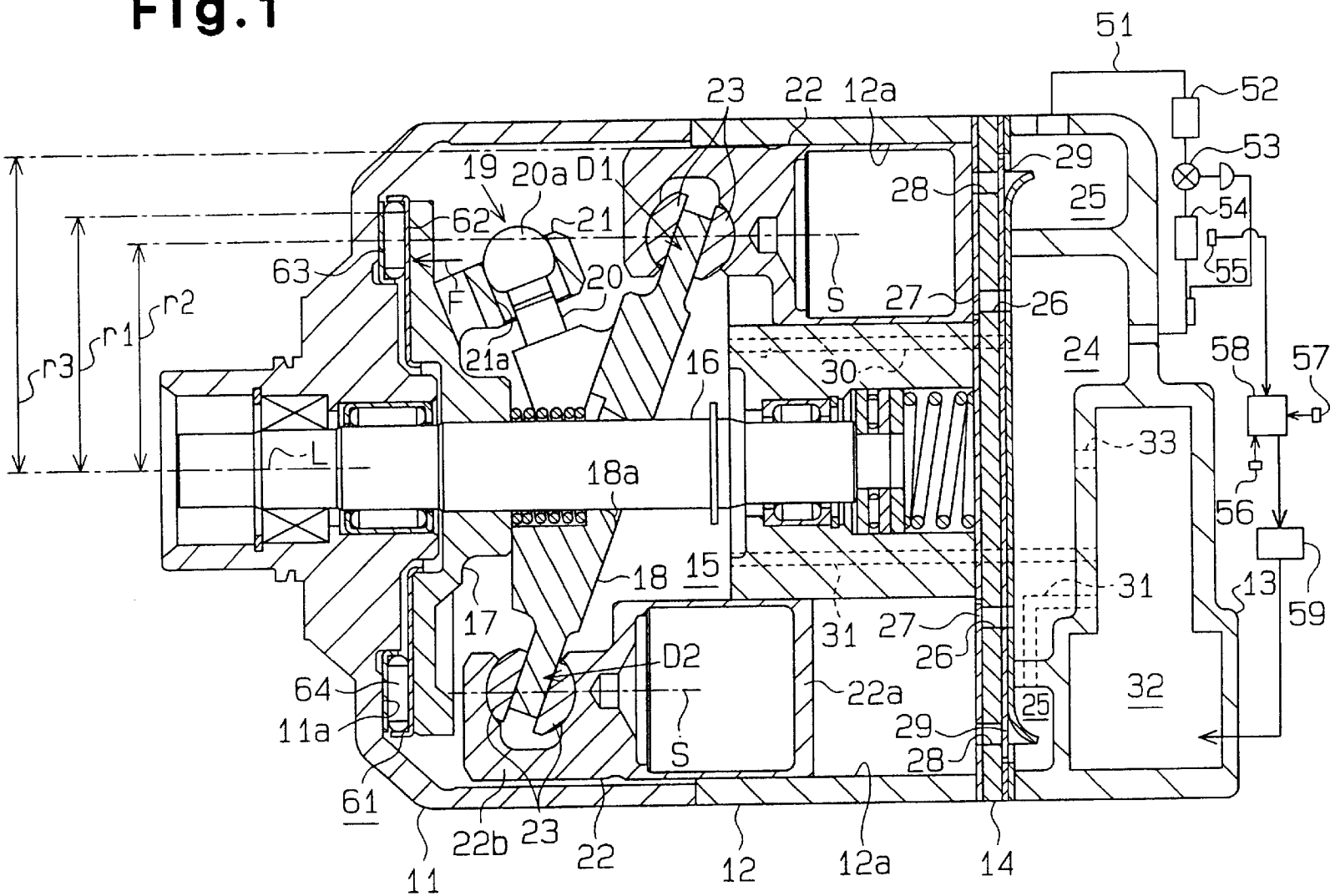
FIG. 1 is a cross sectional view of a variable displacement compressor according to one embodiment of the present invention.

As shown in FIG. 1, a front housing member 11 and a rear housing member 13 are fixed to a cylinder block 12. A valve plate 14 is located between the cylinder block 12 and the rear housing member 13. The front housing member 11, the cylinder block 12, and the rear housing 13 form a housing of the compressor. A crank chamber 15 is defined between the front housing member 11 and the cylinder block 12. A drive shaft 16 is rotatably supported in the front housing member 11 and the cylinder block 12.

In the crank chamber 15, a rotor 17 is fixed to the drive shaft 16. A swash plate 18, which is a drive plate, is supported by the drive shaft 16 in the crank chamber 15 to slide axially and to incline. The swash plate 18 is coupled to the rotor 17 through a hinge mechanism 19. The drive shaft 16 passes through a through hole 18*a* formed in the center of the swash plate 18.

Figure 4:
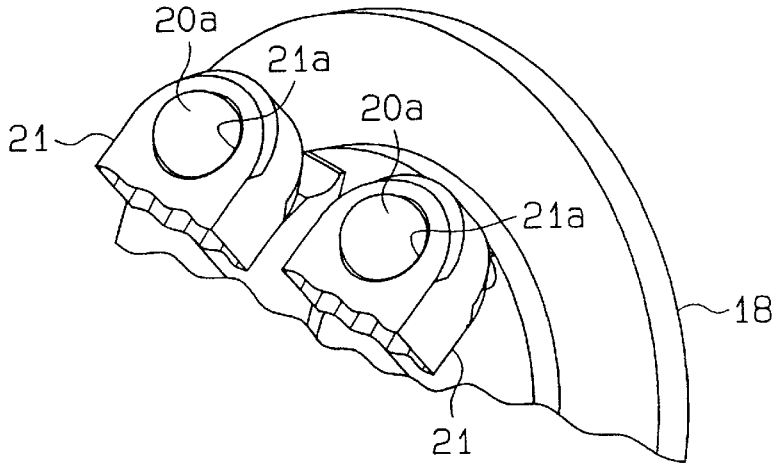
FIG. 4 is a partial perspective view showing the hinge mechanism of the compressor of FIG. 1.

The hinge mechanism 19 includes a pair of guide pins 20 formed on the front surface of the swash plate 18. As shown in FIGS. 1 and 4, a spherical portion 20*a* is formed at the distal end of each guide pin 20. A pair of support arms 21 are formed on the rear surface of the rotor 17. A guide hole 21*a* is formed at the distal end of each support arm 21. The spherical portion 20*a* of each guide pin 20 is received in the guide hole 21*a* of the corresponding support arm 21.

Figure 2:
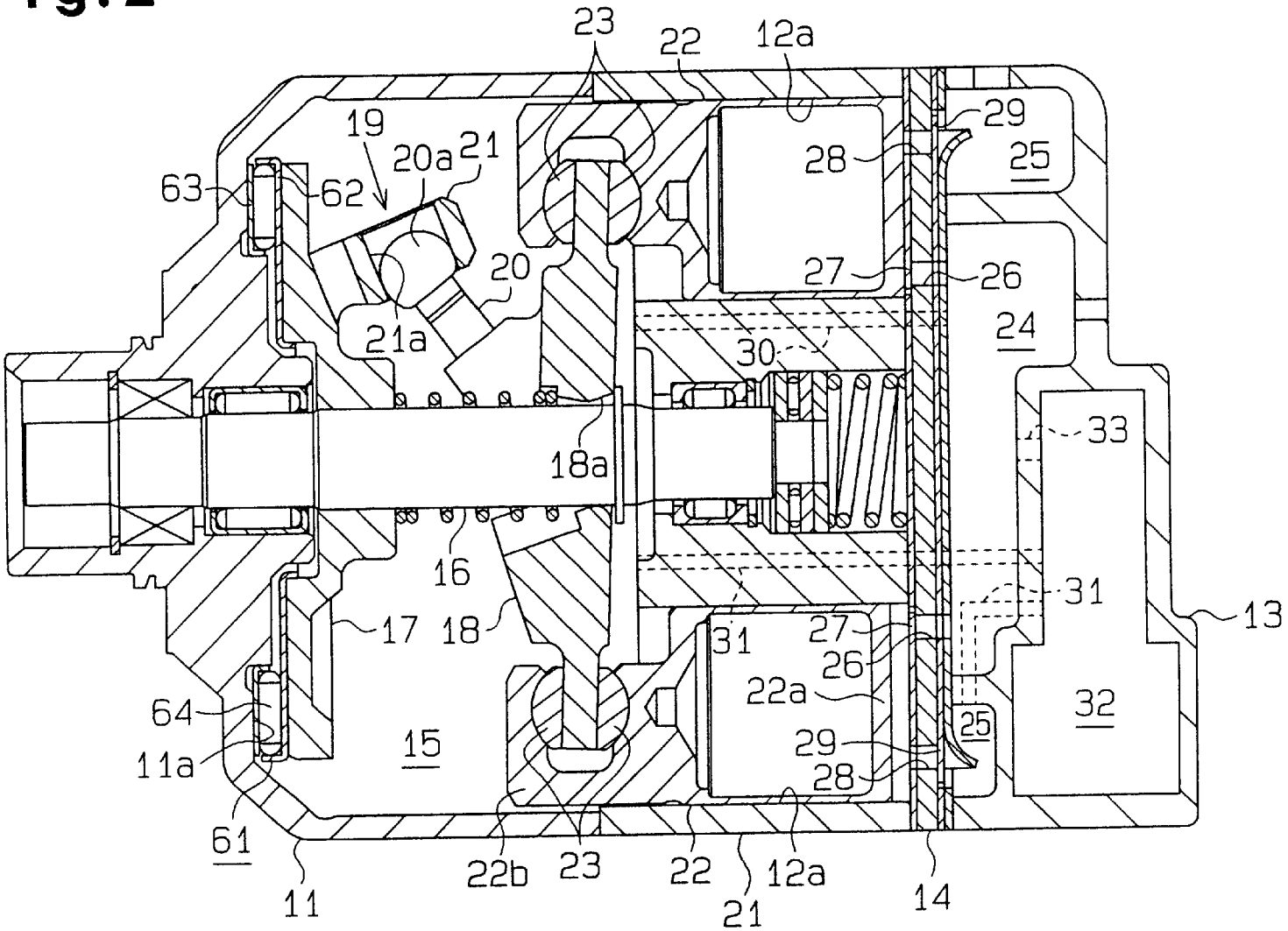
FIG. 2 is a cross sectional view of the compressor of FIG. 1 when the inclination angle of the swash plate is minimized.

The hinge mechanism 19 permits the swash plate 18 to slide axially and to incline with respect to the drive shaft 16. The hinge mechanism 19 integrally rotates the swash plate 18 with the drive shaft 16. As shown in FIG. 2, when the swash plate 18 slides toward the cylinder block 12, the inclination angle of the swash plate 18 decreases. As shown in FIG. 1, when the swash plate 18 slides toward the rotor 17, the inclination angle of the swash plate 18 increases.

Figure 5:
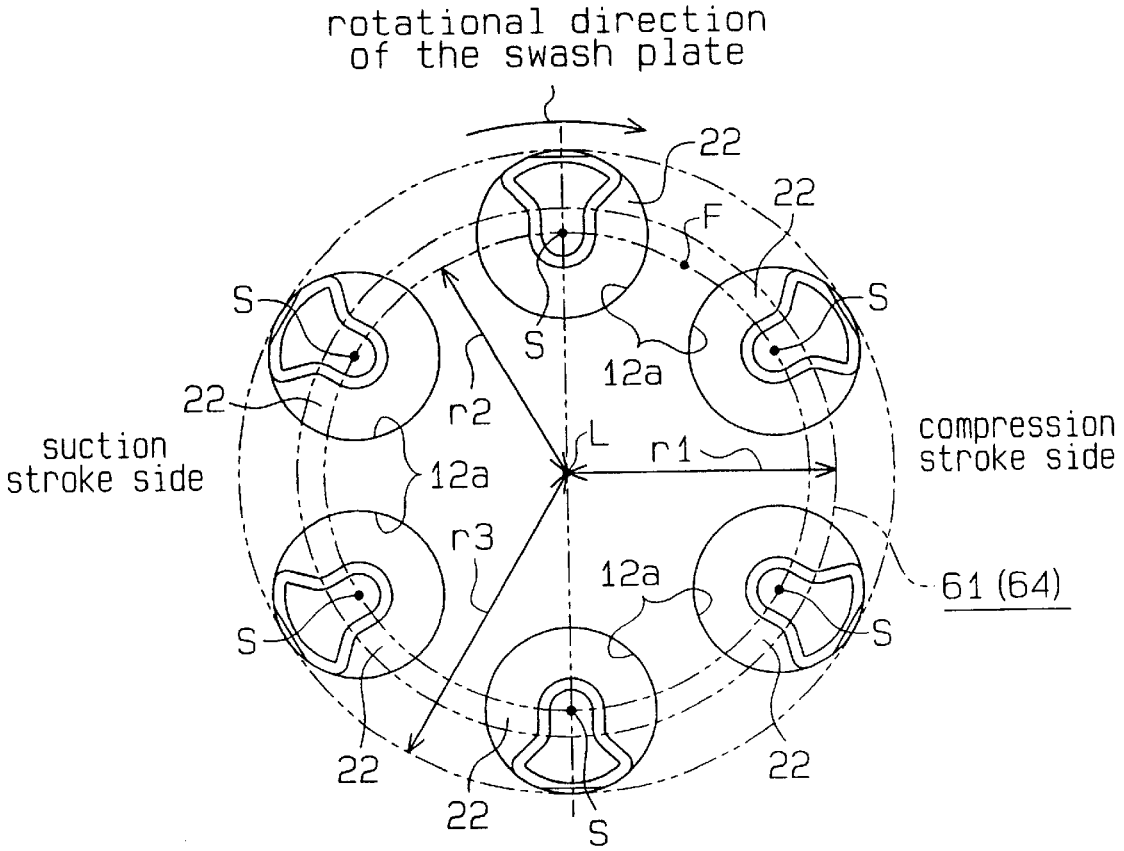
FIG. 5 is a diagrammatic front view illustrating an effective reception radius of the thrust bearing of the compressor of FIG. 1.
Figure 6:
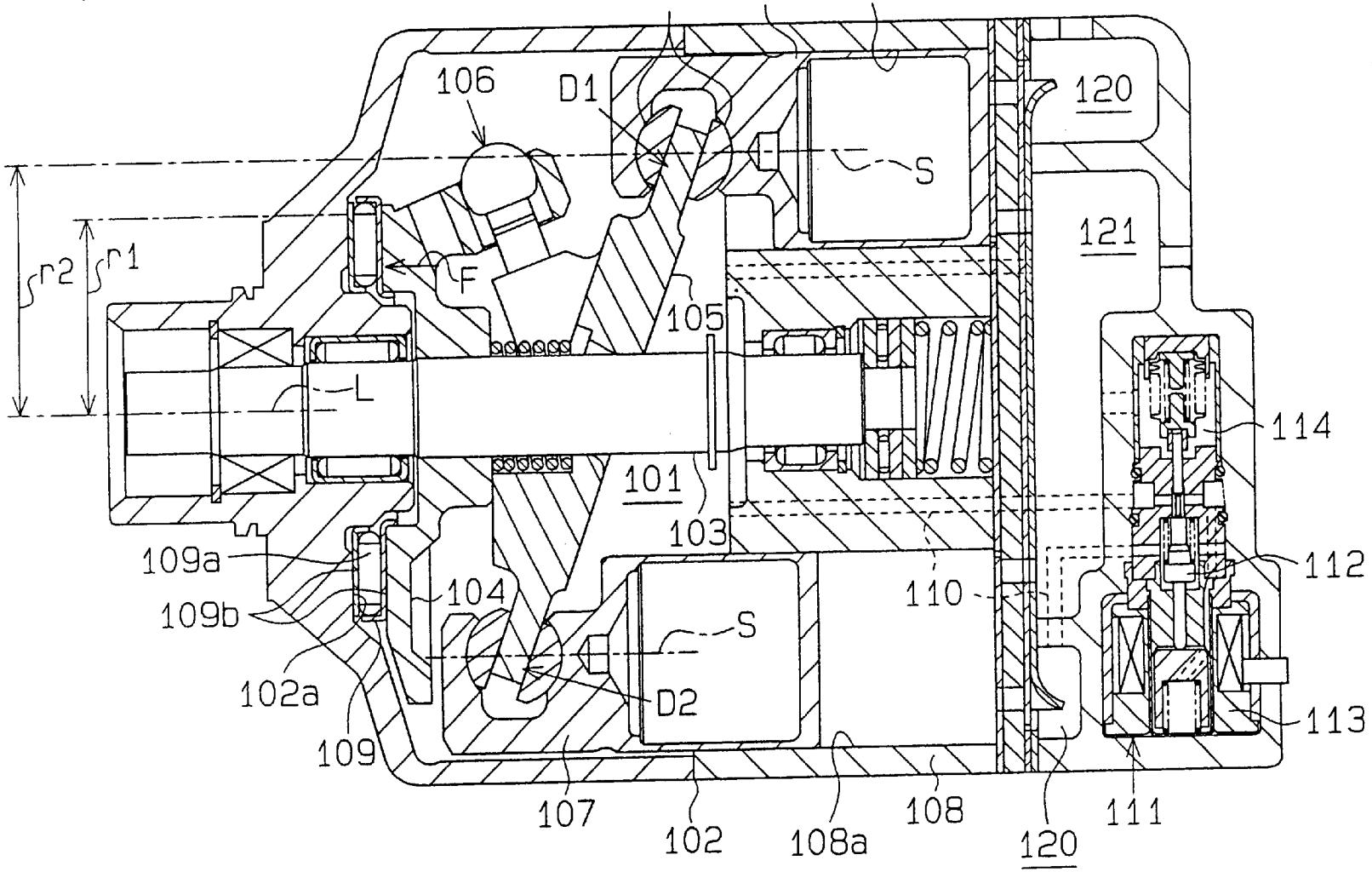
Fig.6(Prior Art)
FIG. 6 is a cross sectional view of a prior art variable displacement compressor.

As shown in FIG. 5, a plurality of cylinder bores 12*a* (six in this embodiment) are formed in the cylinder block 12. The cylinder bores 12*a* are equally spaced about the axis L of the drive shaft 16. A single-head piston 22 having a front portion 22*a* and a rear portion 22*b* is accommodated in each cylinder bore 12*a*. Each piston 22 is coupled to the swash plate 18 through a pair of shoes 23. The rotation of the swash plate 18 is converted into reciprocation of each piston 22 in the corresponding cylinder bore 12*a*.

As shown in FIG. 1, the swash plate 18 includes a point D1 corresponding to the top dead center of each piston 22 and a point D2 corresponding to the bottom dead center of each piston 22. In FIG. 1, the upper piston 22 is positioned at the top dead center by the part of the swash plate 18 that corresponds to point D1, and the lower piston 22 is positioned at the bottom dead center by the part of the swash plate 18 that corresponds to point D2.

A suction chamber 24 and a discharge chamber 25 are respectively defined in the rear housing member 13. A valve plate 14 is sandwiched between the cylinder block 12 and the rear housing 13. The valve plate 14 includes a suction port 26, a suction valve 27, a discharge port 28, and a discharge valve 29 for each cylinder bore 12*a*. When each piston 22 moves from the top dead center to the bottom dead center, refrigerant gas in the suction chamber 24 flows to the corresponding cylinder bore 12*a* from the corresponding suction port 26 through the corresponding suction valve 27. When each piston moves from the bottom dead center to the top dead center, refrigerant gas in the cylinder bore 12*a* is compressed to reach a predetermined pressure and is discharged to the discharge chamber 25 from the corresponding discharge port 28 through the corresponding discharge valve 29.

A bleed passage 30 is formed in the cylinder block 12 and the valve plate 14 to connect the crank chamber 15 to the suction chamber 24. A pressurizing passage 31 is formed in the cylinder block 12, the rear housing member 13 and the valve plate 14 to connect the discharge chamber 25 to the crank chamber 15. A displacement control valve 32 is located in the pressurizing passage 31. An admission passage 33 is formed between the suction chamber 24 and the control valve 32.

Figure 3:
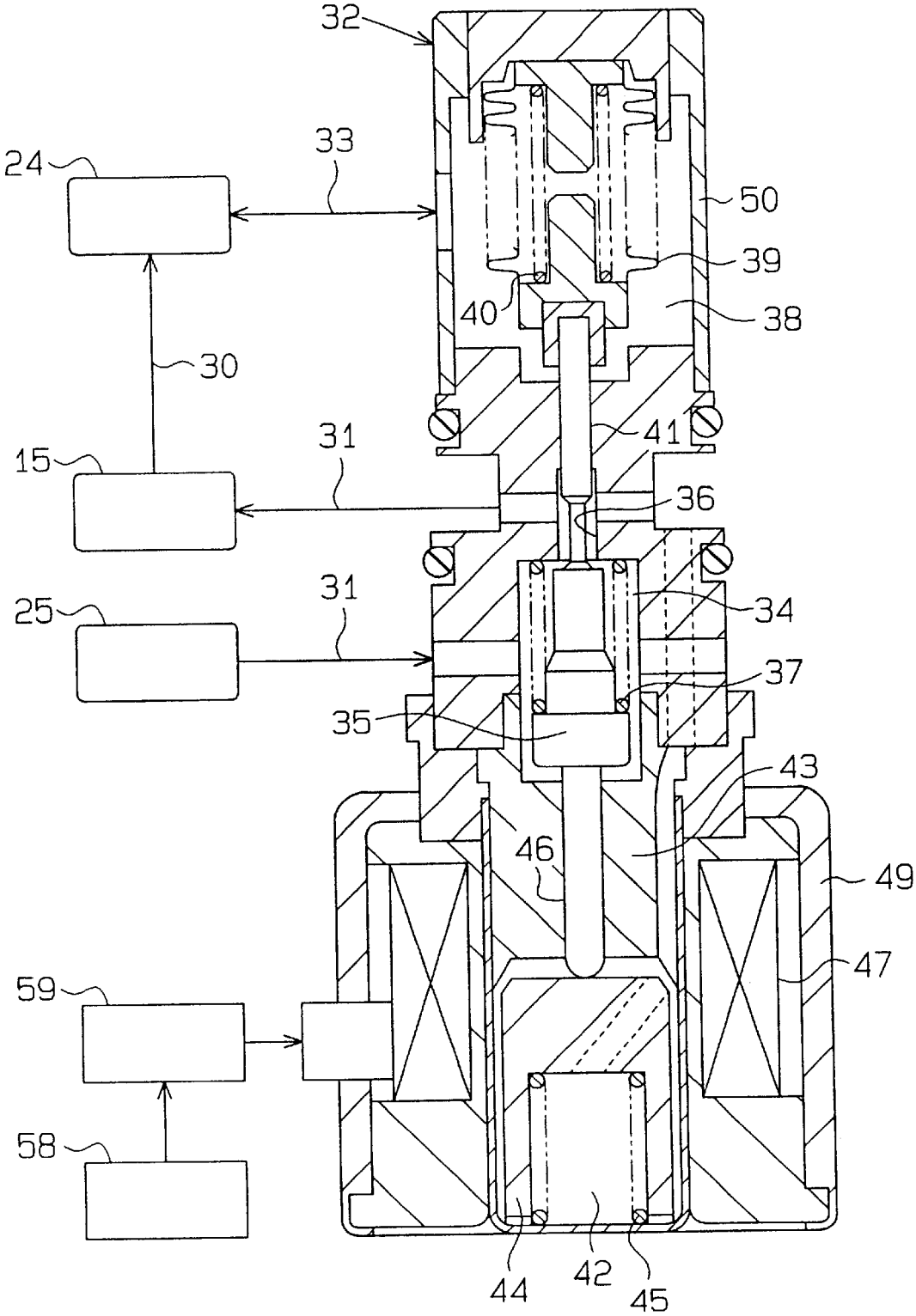
FIG. 3 is a cross sectional view showing the control valve of the compressor of FIG. 1.

As shown in FIG. 3, the control valve 32 includes a valve housing 50 and a solenoid 49, which are joined to one another. A valve chamber 34 is defined between the valve housing 50 and the solenoid 49, and a valve body 35 is accommodated in the valve chamber 34. A valve hole 36 faces the valve body 35 in the valve chamber 34. The valve chamber 34 and the valve hole 36 form part of the pressurizing passage 31. An opener spring 37 is provided between the inner surface of the valve chamber 34 and the valve body 35 and urges the valve body 35 to open the valve hole 36.

A pressure sensitive chamber 38 is formed in the upper portion of the valve housing 50. The pressure sensitive chamber 38 is connected to the suction chamber 24 through the admission passage 33. A bellows 39 is accommodated in the pressure sensitive chamber 38. A spring 40 is arranged in the bellows 39. The spring 40 determines the initial length of the bellows 39. The bellows 39 operates the valve body 35 through a pressure sensitive rod 41. A pressure sensitive chamber 38, the bellows 39, and the pressure sensitive rod 41 form a pressure sensitive mechanism.

A plunger chamber 42 is defined in the solenoid 49, and a fixed iron core 43 is fitted in the upper opening of the plunger chamber 42. A movable iron core 44 is also accommodated in the plunger chamber 42. A follower spring 45 is arranged in the plunger chamber 42 to urge the movable core 44 toward the fixed core 43.

A solenoid rod 46 is integrally formed at the lower end of the valve body 35. The distal end of the solenoid 46 is pressed against the movable core 44 by the opener spring 37 and the follower spring 45. In other words, the valve body 35 moves integrally with the movable core 44 through the solenoid rod 46.

A cylindrical coil 47 is arranged around the fixed core 43 and the movable core 44.

As shown in FIG. 1, the suction chamber 24 is connected to the discharge chamber 25 through an external refrigerant circuit 51. The external refrigerant circuit 51 includes a condenser 52, an expansion valve 53 and an evaporator 54. The refrigerant circuit 51 and the variable displacement compressor form a cooling circuit. A temperature sensor 55, which is located in the vicinity of the evaporator 54, detects the temperature of the evaporator 54, and the detected information is sent to a computer 58. A temperature adjuster 56 and a compartment temperature sensor 57 are connected to the computer 58. The temperature adjuster 56 adjusts the temperature in the vehicle passenger compartment.

The computer 58 instructs a drive circuit 59 to supply a certain value of electric current based on external signals, such as a target temperature set by the temperature adjuster 56, a temperature detected by the temperature sensor 55, and a temperature detected by the compartment temperature sensor 57. The drive circuit 59 outputs the resulting current to the coil 47.

Operation of a variable displacement compressor will now be described.

When the temperature detected by the passenger compartment temperature sensor 57 is higher than a value set by the temperature adjuster 56, the computer 58 instructs the drive circuit 59 to excite the solenoid 49. A predetermined level of electric current is supplied to the coil 47 through the drive circuit 59. This generates an electromagnetic attraction force between the cores 43 and 44 in accordance with the supplied electric current. The attraction is transmitted to the valve body 35 through the solenoid rod 46. Accordingly, the valve body 35 is urged to close the valve hole 36 against the force of the opener spring 37.

On the other hand, the bellows 39 is displaced in accordance with the fluctuation of the suction pressure, which is applied to the pressure sensitive chamber 38 through the admission passage 33. The displacement of the bellows 39 is transmitted to the valve body 35 through the pressure sensitive rod 41. Accordingly, the opening size of the valve hole 36 is determined by the valve body 35 based on the equilibrium of the attraction force between the cores 43, 44 and the force of the bellows 39.

When the opening size of the valve hole 36 is reduced by the valve body 35, the supply of refrigerant gas to the crank chamber 15 from the discharge chamber 25 through the pressurizing passage 31 is reduced. In the meanwhile, refrigerant gas in the crank chamber 15 flows to the suction chamber 25 through the bleed passage 30. Therefore, the pressure in the crank chamber 15 falls. Accordingly, the difference of the pressure in the crank chamber 15 and the pressure in the cylinder bores 12*a* is reduced, which increases the inclination angle of the swash plate 18 and the displacement of the compressor (See FIG. 1).

When the opening size of the valve hole 36 is increased, the supply of refrigerant gas from the discharge chamber 25 to the crank chamber 15 increases, which increases the pressure in the crank chamber 15. This increases the difference between the pressure in the crank chamber 15 and the pressure in the cylinder bores 12*a*, which reduces the inclination of the swash plate 18 and the displacement of the compressor (See FIG. 2).

When the cooling load is great, the difference between the temperature detected by the temperature sensor 57 and the temperature set by the temperature adjuster 56 is great. The greater the temperature difference is, the greater electric current the computer 58 instructs the drive circuit 59 to supply to the coil 47 of the control valve 32. This increases attraction force between the fixed core 43 and the movable core 44 and more strongly urges the valve body 35 to close the valve hole 36. Therefore, the bellows 39 operates the valve body 35 to target a lower suction pressure. In other words, as the supply of electric current increases, the control valve operates in a manner to maintain a lower suction pressure (target value).

When the cooling load is small, the difference between the temperature detected by the sensor 57 and the temperature set by the temperature adjuster 56 is small. The smaller the temperature difference is, the smaller the electric current the computer 58 instructs the drive circuit 59 to supply to the coil 47. This reduces the attraction force between the fixed core 43 and the movable core 44 and reduces the force that urges the valve body 35 to close the valve hole 36. Therefore, the bellows 39 operates the valve body 35 to raise the target suction pressure. In other words, as the supply of electric current decreases, the control valve 32 operates in a manner to maintain a higher pressure (a target value in the suction chamber 24).

As described, the control valve 32 changes the target value of the suction pressure in accordance with the value of the electric current supplied to the coil 47. The compressor controls the inclination angle of the swash plate 18 so that the suction pressure is maintained at the target value, which adjusts the displacement.

As shown in FIG. 1, a thrust bearing 61 is located between the front surface of the rotor 17 and the inner surface 11*a* of the front housing member 11. The thrust bearing 61, which is annular, is arranged about the axis L of the drive shaft 16. The thrust bearing 61 receives a compression load applied to the rotor 17 from the pistons 22 through the hinge mechanism 19.

The thrust bearing 61 includes an annular moving race 62, an annular fixed race 63, and a plurality (two shown in FIG. 1) of rollers 64 arranged between the races 62, 63. The moving race 62 is fixed to the rotor 17, and the fixed race 63 is fixed to the inner surface 11*a* of the front housing member 11. The axes of the rollers coincide with radial lines about the axis L. Each roller 64 rolls between the races 62, 63 and orbits about the axis L with relative rotation between the races 62, 63 as the rotor 17 rotates.

As shown in FIGS. 1 and 5, the effective reception radius r1 of the thrust bearing 61 is greater than the piston axis radius r2, which extends from the axis L of the drive shaft 16 to the axis S of each piston 22. Within the effective reception radius r1, the resultant force F from the rotor 17 is directly received by the bearing 61. The radius r1 is defined by the outermost contact points between the rollers 64 and the races 62, 63. The effective reception radius r1 is smaller than an outer bore radius r3, which is the radius of a hypothetical circle about the axis L that touches the radially outermost extremity of each cylinder bore 12*a*.

The illustrated embodiment has the following advantages.

Figure 7:
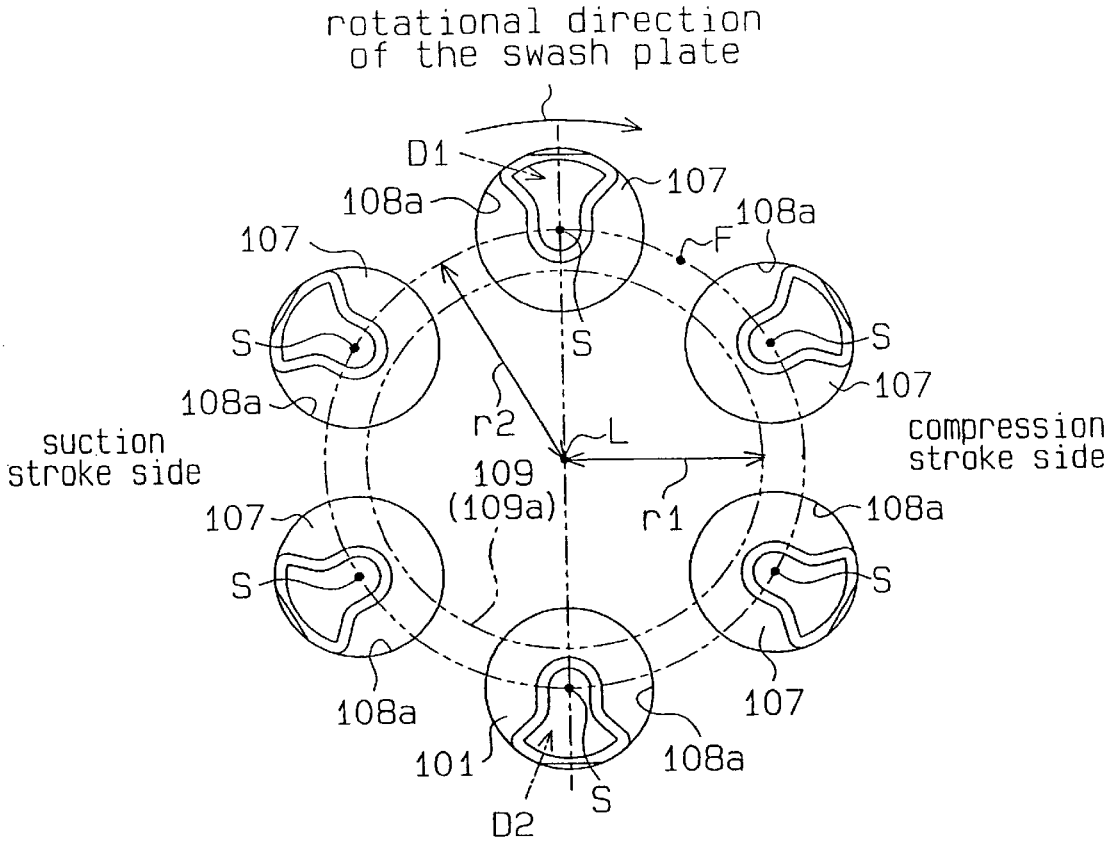
Fig.7 (Prior Art)
FIG. 7 is a diagrammatic front view illustrating an effective reception radius of the thrust bearing of the compressor of FIG. 6.

As described with reference to FIG. 7, when the compression ratio is small, the location of the resultant force F applied to the swash plate from the pistons is spaced from the axis L of the drive shaft 16 by the piston axis radius r2. However, in the illustrated embodiment, the effective reception radius r1 of the thrust bearing 61 is greater than the piston axis radius r2. Therefore, the location of the resultant force F is within the effective reception radius r1 when the compression ratio is small. Therefore, the resultant force F is directly received by the thrust bearing 61 through the rotor 17. This prevents the inclination of the rotor 17 and noise and vibration that accompany chattering of the rotor 17.

In a compressor according to the illustrated embodiment, the volume of each cylinder bore 12*a* when the corresponding piston 22 is at the top dead center, that is, a dead volume, is substantially null. When the dead volume is greater due to measurement error in the parts, the compression ratio becomes lower. In this case, the position of the resultant force F is farther from the axis L of the drive shaft 16 than the piston axis radius r2. However, in the illustrated embodiment, the effective reception radius r1 of the thrust bearing 61 is greater than the piston axis radius r2. In other words, the effective reception radius r1 is between the piston axis radius r2 and the outer bore radius r3. The force from the rotor 17 is directly received by the thrust bearing 61 regardless of measurement errors.

Regardless of the operating condition of the compressor, the radial location of the resultant force F applied to the swash plate from the pistons does not exceed the outer bore radius r3. Accordingly, the size of the compressor is not unnecessarily increased, and the resultant force F applied to the swash plate 18 from the pistons 22 is received within the effective reception radius r1.

The thrust bearing 61 is a roller bearing including the rollers 64. Accordingly, compared to a plain bearing without the rollers 64, the thrust bearing 61 provides smoother rotation of the rotor 17 and is more durable.

The present invention is not limited to the illustrated embodiment and can further be varied as follows.

Instead of the control valve 32 having the valve body 35 operated by the pressure sensitive mechanism 14 and the solenoid 49, a control valve having the valve body 35 operated by the solenoid 49 alone may be used. If the valve body 35 of the control valve 32 is operated by the pressure sensitive mechanism alone, the compression ratio cannot be varied since the relation between the suction pressure and the discharge pressure is fixed.

At least one of the races 62, 63 may be omitted. The rollers 64 may be located between one of the races 62, 63 and one of the front surface of the rotor 17 and the inner surface 11*a* of the front housing member 11.

The rollers 64 of the thrust bearing 61 may be balls. Also, the thrust bearing 61 is not limited to a roller bearing but may be a plain bearing.

The control valve 32 may be located in the bleed passage 30, and the displacement of the compressor may be adjusted by adjusting the opening size of the bleed passage 30.

A control valve 32 may be located in each of the bleed passage 30 and the pressurizing passage 31, and the displacement of the compressor may be adjusted by adjusting the opening size of both the bleed passage 30 and the pressurizing passage 31.

The present invention may be embodied in a wobble-type variable displacement compressor.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A variable displacement compressor comprising:

a housing, which defines a crank chamber, a suction chamber and a discharge chamber;

a drive shaft rotatably supported in the housing;

a plurality of cylinder bores formed in the housing, wherein each cylinder bore is arranged on a circle, the center of which is the axis of the drive shaft;

a plurality of pistons, each piston being accommodated in one of cylinder bores;

a drive plate coupled to the pistons for converting rotation of the drive shaft to reciprocation of the pistons, wherein the drive plate inclines and slides axially along the drive shaft, which varies the piston stroke to change the displacement of the compressor;

a control valve for controlling the pressure in the crank chamber to change the inclination of the drive plate, wherein the control valve includes a valve body and an electric drive means for applying force to the valve body corresponding to the value of an electric current fed to the electric drive means;

a rotor mounted on the drive shaft to rotate integrally with the drive shaft, wherein the rotor includes a receiving portion, which is a peripheral portion of the rotor;

a hinge mechanism located between the rotor and the drive plate for rotating the drive plate integrally with the rotor and for guiding the motion of the drive plate, wherein the hinge mechanism has a guide pin and a support arm, the guide pin extends from the drive plate, the support arm has a guide hole for receiving a distal end portion of the guide pin, and the distal end portion of the guide pin is radially inward of the receiving portion, and wherein the support arm joins the rotor at a location radially inward of the receiving portion; and a thrust bearing located between the receiving portion of the rotor and the housing, the thrust bearing receiving a resultant force from the pistons through the drive plate and the hinge mechanism, wherein an effective reception radius, which is defined by an outermost load-bearing point of the thrust bearing, is greater than the distance from the axis of the drive shaft to the axis of any one of the pistons, the outermost load-bearing point being located radially outward of the distal end portion of the guide pin, and wherein the distance from the axis of the drive shaft to an innermost load-bearing point of the thrust bearing is smaller than the distance from the axis of the drive shaft to the axis of any one of the pistons.

2. The compressor according to claim 1, wherein the effective reception radius is smaller than the radius of a hypothetical circle that is centered on the axis of the drive shaft and that surrounds and touches the cylinder bores.

3. The compressor according to claim 1, wherein the thrust bearing is a roller bearing annularly arranged about the axis of the drive shaft, wherein the roller bearing has a race that holds rollers.

4. The compressor according to claim 1, wherein the control valve has a sensing mechanism, which operates the valve body in accordance with the pressure in the suction chamber.

5. The compressor according to claim 1, wherein the electric drive means is a solenoid.

6. A variable displacement compressor comprising:

a housing, which defines a crank chamber, a suction chamber and a discharge chamber;

a drive shaft rotatably supported in the housing;

a plurality of cylinder bores formed in the housing, wherein each cylinder bore is arranged on a circle, the center of which is the axis of the drive shaft;

a plurality of pistons, each piston being accommodated in one of the cylinder bores;

a swash plate coupled to the pistons for converting rotation of the drive shaft to reciprocation of the pistons, wherein the swash plate inclines and slides axially along the drive shaft, which varies the piston stroke to change the displacement of the compressor;

a control valve for controlling the pressure in the crank chamber to change the inclination of the swash plate, wherein the control valve includes a valve body and a solenoid for applying force to the valve body corresponding to the value of an electric current fed to the solenoid;

a rotor mounted on the drive shaft to rotate integrally with the drive shaft, wherein the rotor includes a receiving portion, which is peripheral portion of the rotor, a hinge mechanism located between the rotor and the swash plate for rotating the swash plate integrally with the rotor and for guiding the motion of the swash plate, wherein the hinge mechanism has a guide pin and a support arm, the guide pin extends from the drive plate, the support arm has a guide hole for receiving a distal end portion of the guide pin, and the distal end portion of the guide pin is radially inward of the receiving portion, and wherein the support arm joins the rotor at a location radially inward of the receiving portion; and a thrust bearing located between the receiving portion of the rotor and the housing, wherein the thrust bearing is a roller bearing annularly arranged about the axis of the drive shaft, wherein the roller bearing has a race that holds rollers, the thrust bearing receiving a resultant force from the pistons through the swash plate and the hinge mechanism, wherein an effective reception radius, which is defined by an outermost load-bearing point of the thrust bearing, is greater than the distance from the axis of the drive shaft to the axis of any one of the pistons, and is smaller than the radius of a hypothetical circle that is centered on the axis of the drive shaft and that surrounds and touches the cylinder bores, the outermost load-bearing point being located a radially outward of the distal end portion of the guide pin, and wherein the distance from the axis of the drive shaft to an innermost load-bearing point of the thrust bearing is smaller than the distance from the axis of the drive shaft to the axis of any one of the pistons.

7. The compressor according to claim 6, wherein the control valve has a sensing mechanism, which operates the valve body in accordance with the pressure in the suction chamber.

8. A variable displacement compressor comprising:

a housing, which defines a crank chamber, a suction chamber and a discharge chamber;

a drive shaft rotatably supported in the housing;

a plurality of cylinder bores formed in the housing, wherein each cylinder bore is arranged on a circle, the center of which is the axis of the drive shaft;

a plurality of pistons, each piston being accommodated in one of the cylinder bores;

a swash plate coupled to the pistons for converting rotation of the drive shaft to reciprocation of the pistons, wherein the swash plate inclines and slides axially along the drive shaft, which varies the piston stroke to change the displacement of the compressor;

a control valve for controlling the pressure in the crank chamber to change the inclination of the swash plate, wherein the control valve includes a valve body and a solenoid for applying force to the valve body corresponding to the value of an electric current fed to the solenoid;

a rotor mounted on the drive shaft to rotate integrally with the drive shaft, wherein the rotor includes a receiving portion, which is a peripheral portion of the rotor;

a hinge mechanism located between the rotor and the swash plate for rotating the swash plate integrally with the rotor and for guiding the motion of the swash plate, wherein the hinge mechanism has a guide pin and a support arm, the guide pin extends from the drive plate, the support arm has a guide hole for receiving a distal end portion of the guide pin and the distal end portion of the guide pin is radially inward of the receiving portion, and wherein the support arm joins the rotor at a location radially inward of the receiving portion; and an annular thrust bearing that is coaxial to the drive shaft and is located between the receiving portion of the rotor and the housing, wherein outermost load-bearing points of the thrust bearing are radially farther from the axis of the drive shaft than the axes of the pistons and are located a radially outward of the distal end portion of the guide pin, and wherein the distance from the axis of the drive shaft to an innermost load bearing point of the thrust bearing is smaller than the distance from the axis of the drive shaft to the axis of any one of the pistons.

* * * * *

UNITED STATES PATENT AND TRADEMARK OFFICE

CERTIFICATE OF CORRECTION

PATENT NO. : 6,368,069 B1
DATED : April 9, 2002
INVENTOR(S) : Tetsuhiko Fukanuma et al.

It is certified that error appears in the above-identified patent and that said Letters Patent is hereby corrected as shown below:

Title page,
Item [56], References Cited, U.S. PATENT DOCUMENTS, after
"5,921,756 A * 7/1999 Matsuda et al. .....417/269" please add
-- 5,975,859 11/1999 Kawaguchi et al. .....417/222.2 --;
FOREIGN PATENT DOCUMENTS, before
"JP 06-299958 10/1994" please add
-- JP 01-124387 08/1989
DE 39 04 659 A1 08/1989
JP 02-162119 06/1990 --; after
"JP 08-338364 12/1996" please add
-- DE 198 01 975 A1 07/1998 --;

Column 4,
Line 49, please delete "22 having" and insert therefor -- 22 (having --;
Line 50, please delete "22*b* is" and insert therefor -- 22*b*) is --;

Signed and Sealed this

Twenty-second Day of October, 2002

*Attest:*

*Attesting Officer*

JAMES E. ROGAN
*Director of the United States Patent and Trademark Office*